United States Patent [19]

Karns, III

[11] 4,066,134

[45] Jan. 3, 1978

[54] HYDRAULIC POST HOLE AUGER APPARATUS

[76] Inventor: Ed Karns, III, 400 N. River Road, Apt. 1137, West Lafayette, Ind. 47906

[21] Appl. No.: 670,393

[22] Filed: Mar. 25, 1976

[51] Int. Cl.[2] ..... A01B 49/04

[52] U.S. Cl. ..... 173/27; 173/38

[58] Field of Search ..... 172/111; 173/26–28, 173/38, 140, 160

[56] References Cited

U.S. PATENT DOCUMENTS

| | | | |
|---|---|---|---|
| 2,734,722 | 2/1956 | Pokorny | 173/27 X |
| 2,812,162 | 11/1957 | Lay | 173/27 X |
| 2,959,398 | 11/1960 | Troche | 173/28 X |
| 3,022,839 | 2/1962 | Troche | 173/28 X |
| 3,073,396 | 1/1963 | Eckels | 173/38 X |
| 3,165,157 | 1/1965 | Carbert | 173/28 |
| 3,213,948 | 10/1965 | Eckels | 173/38 X |
| 3,327,789 | 6/1967 | Furuseth | 173/38 |
| 3,604,521 | 9/1971 | Collins | 173/38 |

FOREIGN PATENT DOCUMENTS

| | | | |
|---|---|---|---|
| 675,274 | 12/1963 | Canada | 173/28 |

*Primary Examiner*—Lawrence J. Staab

*Attorney, Agent, or Firm*—Gust, Irish, Jeffers & Rickert

[57] ABSTRACT

A hydraulically driven post hole auger apparatus for attachment to implement lifting mechanism of a vehicle. The apparatus includes a cylindrical housing having a speed-reducing gear box therein. The gear box has an output shaft extending through an opening in an end wall of the housing and adapted to have the auger attached thereto. A hydraulic motor in the housing is operatively coupled to the gear box. A universal joint mechanism couples the housing to a support member. The support member may be one end of a boom having its other end pivotally connected to the rear end of a tractor. Linkage connects the boom to the power-actuated lifting levers at the rear of the tractor for selectively raising and lowering the boom and the auger apparatus. The support member alternatively may be a bracket assembly adapted to be removably clamped to an arm of front end loader apparatus, the arm being pivotally connected to a tractor.

2 Claims, 5 Drawing Figures

HYDRAULIC POST HOLE AUGER APPARATUS

BACKGROUND OF THE INVENTION

1. Field of the Invention

This invention relates generally to post hole auger apparatus, and more particularly to a hydraulically driven post hole auger apparatus for attachment to the implement lifting mechanism of a vehicle.

2. Description of the Prior Art

Numerous arrangements have been proposed for attaching post hole auger apparatus to the rear end of a vehicle such as a farm tractor as shown, for example, in U.S. Pat. No. 3,604,521. To the best of the present applicant's knowledge, such prior vehiclemounted post hole auger apparatus was driven from the mechanical power take-off of the vehicle and further involved unnecessarily complicated linkage for raising and lowering the auger assembly.

It has also been proposed to mount post hole auger apparatus on a supporting arm of front end loader apparatus which is pivotally connected to a tractor and extends forwardly therefrom as shown, for example, in U.S. Pat. No. 3,327,789. While such apparatus has employed a hydraulic motor for driving the auger, removal of the front end loader component from the supporting arms was necessary. Further, to the best of the present applicant's knowledge, interchangeability of the post hole auger apparatus from rear end mounting to front end loader mounting was not provided.

It is therefore desirable to provide hydraulically driven post hole auger apparatus adapted for ready mounting on the rear of a vehicle such as a tractor or a utility truck for movement by the power lifting mechanism of the vehicle or, alternatively, for ready mounting on an arm of other apparatus such as front end loading or back hoe apparatus.

SUMMARY OF THE INVENTION

In accordance with the invention, a cylindrical housing is provided having a side wall and one end wall and being open at its opposite end. A speed-reducing gear box is provided in the housing having an output shaft extending through an opening in the end wall and adapted to have an auger attached thereto. A hydraulic motor is also provided in the housing operatively coupled to the gear box. A first elongated member extends transversely across the side wall adjacent the open end and is pivotally connected thereto, and a second elongated member is secured to the first member at right angles thereto. A support member having a pair of spaced elements is provided, the second elongated member extending transversely between the elements and is pivotally connected thereto thereby providing universal mounting of the casing and auger. Means are provided for connecting the support member to implement lifting mechanism of a vehicle.

In one embodiment, the support member comprises an elongated boom, the spaced elements being at one end thereof and the opposite end being pivotally connected to the rear end of a tractor. In that embodiment, the lifting mechanism is a pair of power-actuated levers at the rear end of the tractor, and the connecting means comprises linkage coupling the levers to the boom for pivotally raising and lowering the same.

In another embodiment, the lifting mechanism comprises a power-actuated arm of front end loading apparatus having one end pivotally connected to the tractor, and the connecting means removably connects the support member to the arm intermediate its ends.

It is accordingly an object of the invention to provide improved post hole auger apparatus for attachment to implement lifting mechanism of a vehicle.

Another object of the invention is to provide improved hydraulically driven post hole auger apparatus.

A further object of the invention is to provide improved post hole auger apparatus for attachment to the rear end of a tractor.

Yet another object of the invention is to provide improved post hole auger apparatus for attachment to front end loading apparatus of a tractor.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
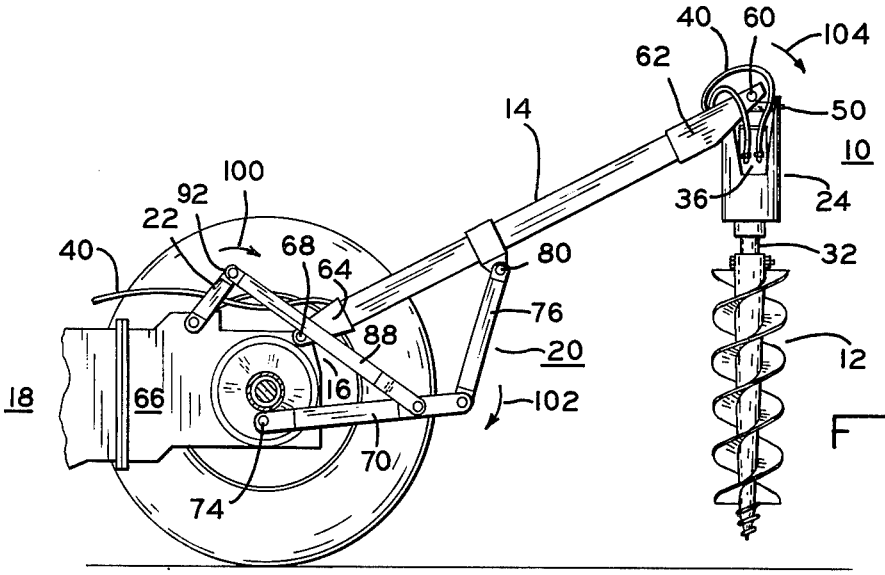
FIG. 1 is a side view of the improved post hole auger apparatus of the invention attached to the rear end of a tractor.
Figure 2:
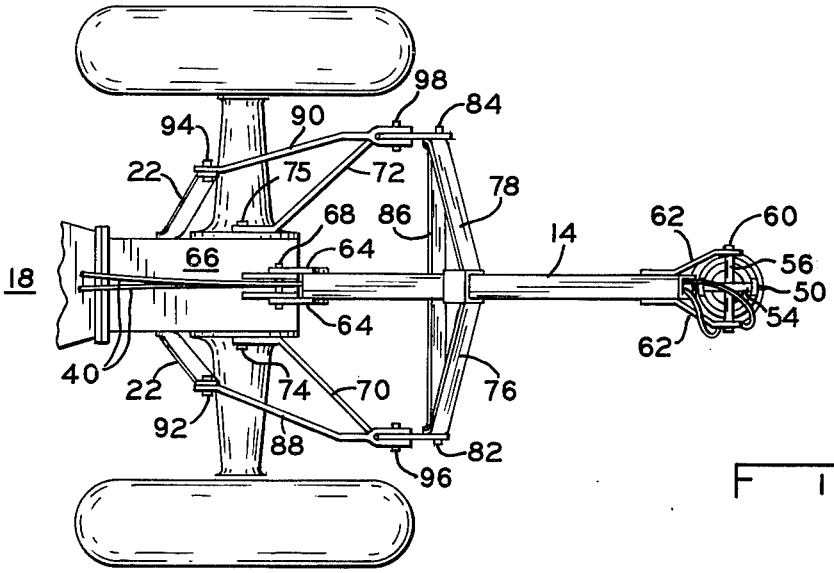
FIG. 2 is a top view of the apparatus of FIG. 1.
Figure 3:
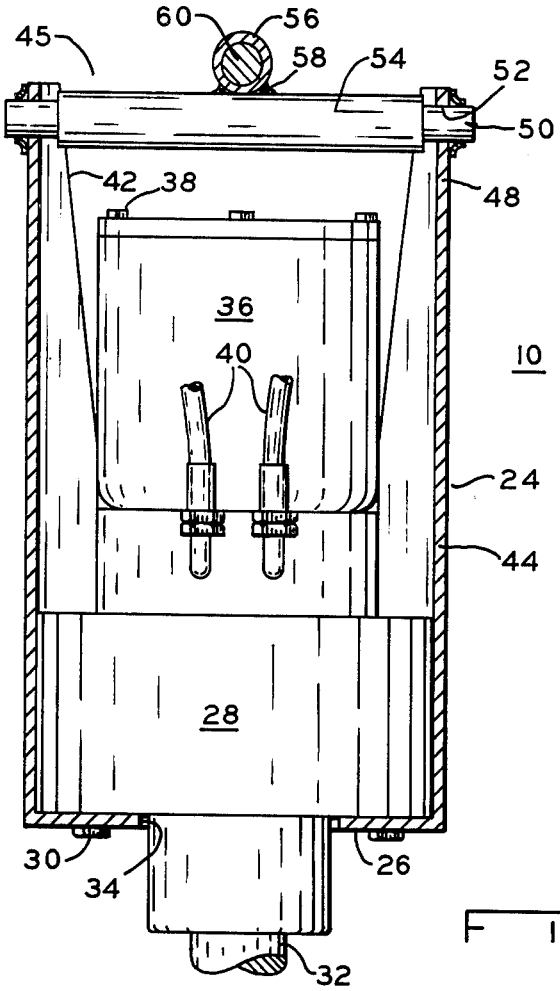
FIG. 3 is a cross-sectional view of the apparatus of the invention.

Referring now to FIGS. 1–3 of the drawings, in this embodiment, drive unit 10 to which auger 12 is connected is attached to boom 14 pivotally connected to rear end 16 of tractor 18, boom 14 being raised and lowered by linkage 20 connected to the conventional power implement-lifting levers 22 at the rear end of tractor 18 and actuated thereby.

Referring now particularly to FIG. 3, drive unit 10 comprises cylindrical casing 24 having end wall 26. Gear box 28 is positioned in housing 24 abuting end wall 26 and secured thereto in any suitable manner, as by threaded fasteners 30. Gear box 28 has output shaft 32 which extends downwardly through opening 34 in end wall 26. Gear box 28 may be of the planetary type and in a specific embodiment of the invention, provides a four-to-one speed reduction ratio.

Hydraulic motor 36 is positioned in housing 24 and is operatively coupled to drive gear box 28. Motor 36 may be attached to gear box 28 in any suitable manner, as by through-bolts 38. Hydraulic hoses 40 are connected to motor 36 in conventional fashion. Hydraulic motor 36 may be of the roller-vane type which provides a speed reduction which, in the specific embodiment, is a six-to-one reduction.

Housing 24 has a pair of opposite, cut-out portions 42 formed in its side wall 44 extending downwardly from its open upper end 45, cut-out portions 42 accommodating hydraulic hoses 40. Cutout portions 42 respectively define opposite, upstanding leg portions 46, 48.

Pin 50 has its opposite ends respectively received in openings 52 in leg portions 46, 48. Sleeve 54 is rotatably mounted on pin 50 between leg portions 46, 48. Sleeve 56 which extends at right angles to sleeve 54 is secured thereto, as by welding at 58. Sleeve 56 rotatably receives pin 60.

Referring additionally to FIGS. 1 and 2, the opposite ends of pin 60 are connected to spaced-apart arms 62 secured to the outer end of boom 14, as by welding. The inner end of boom 14, which preferably is a hollow tube, has plates 64 secured thereto, as by welding, plate 64 being pivotally connected to housing 66 at rear end 16 of tractor 18, as at 68. Connection 68 on tractor 18 is normally employed for pivotally supporting farm implements such as plows and the like. Hoses 40 which convey hydraulic fluid to and from hydraulic motor 36 extend through boom 14, as shown.

Linkage 20 comprises first links 70, 72 having their inner ends pivotally connected to housing 66, as at 74, 75 and second links 76, 78 having their upper ends pivotally connected to boom 14 intermediate its ends, as at 80. The outer and lower ends of links 70, 72 and 76, 78 are respectively pivotally connected, as at 82, 84. Bracket 86 extends between lower ends of links 76, 78. Pivot connections 74, 75 on housing 66 are customarily employed for supporting farm implements, such as plows and the like. Links 88, 90 respectively have their forward ends pivotally connected to power levers 22, as at 92, 94, and their rear ends pivotally connected to links 70, 72, as at 96, 98.

It will now be seen that drive unit 10 and auger 12 are connected to the outer end of boom 14 by a universal joint assembly comprising pins 50, 60 and their associated sleeves 54, 56. It will further be seen that rotation of power levers 22 in the direction shown by arrow 100 will result in downward movement of the outer ends of links 70, 72, as shown by arrow 102, which will result in downward movement of the outer end of boom 14 along with drive unit 10 and auger 12, as shown by arrow 104. It will be further seen that the auger assembly shown in FIGS. 1 and 2 is readily assembled on and removed from tractor 18 by means of five pivot pins 68, 74, 75, 92, 94, all of which are provided in conventional farm tractors adapted to have towed farm implements mounted thereon.

Figure 5:
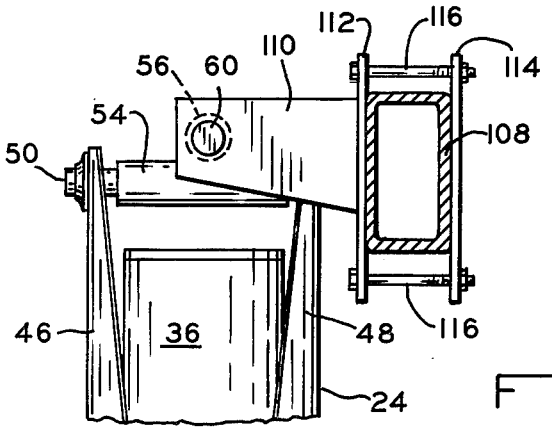
FIG. 5 is a fragmentary view, partly in cross-section, showing the attachment of the auger apparatus of the invention to an arm of front end loading apparatus.
Figure 4:
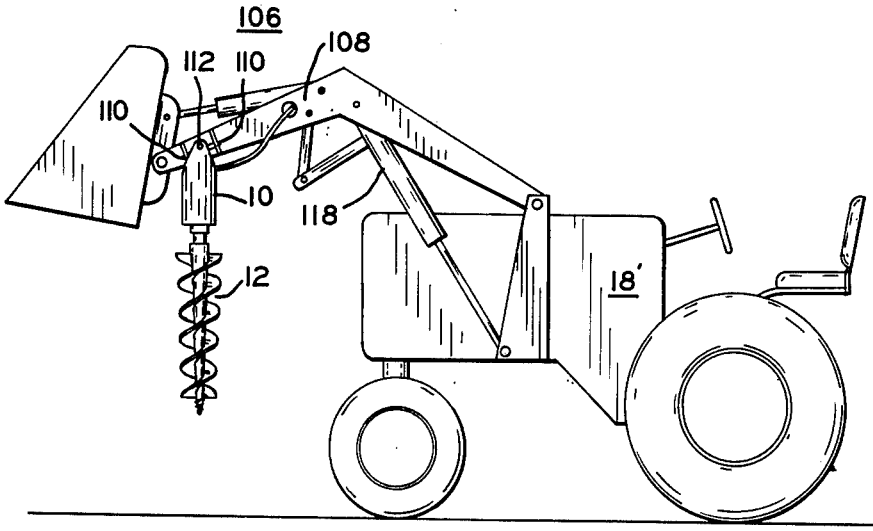
FIG. 4 is a side view showing an embodiment of the invention attached to front end loader apparatus.

Referring now to FIGS. 4 and 5, in which like elements are indicated by like reference numerals, there is shown conventional front end loader apparatus 106 mounted on tractor 18'. Front end loader apparatus 106 includes a pair of pivoted arms 108 (only one of which is shown). Auger drive unit 10 and auger 12 are removably mounted on arm 108 as will now be described.

A pair of spaced-apart support members 110 are secured to plate 112, as by welding, and extend outwardly therefrom. Pin 60 which suspends drive unit 10 and auger 12 extends transversely between members 110 and has its opposite ends connected thereto with sleeve 56 therebetween. Plate 112 engages one side of arm 108 and another plate 114 engages the other side, the two plates being secured in clamping relationship with arm 108 by means of suitable threaded fasteners 116.

It will be seen that drive unit 10 and auger 12 are removably attached to arm 108 of front end load apparatus 106, the universal connection provided by pins 50, 60 and their respective sleeves 54, 56 permitting the auger assembly to hang vertically in any inclined position of arm 108. It will be readily understood that arm 108 of front end loader assembly 106 is raised and lowered by means of conventional hydraulic cylinder 118.

It will now be seen that the invention provides simple, sturdy and economical hydraulically driven post hole auger apparatus which can readily be attached to the implement attachment means of a farm tractor or alternatively to a front end loader. It will be seen further that the apparatus of the invention can also be readily attached to the implement lifting mechanism of other vehicles, such as a utility truck having an articulated aerial tower mounted thereon, or a back hoe.

While there have been described above the principles of this invention in connection with specific apparatus, it is to be clearly understood that this description is made only by way of example and not as a limitation to the scope of the invention.

What is claimed is:

1. A hydraulically driven post hole auger apparatus for attachment to the power-actuated arm of the front end loading apparatus of a tractor, said arm having opposite ends with one end pivotally connected to the tractor, comprising: first and second plates respectively engaging opposite sides of said arm and fastener means for connecting said plates and removably clamping the same on said arm; a pair of spaced support elements secured to one of said plates; a cylindrical housing having a side wall and one end wall and being open at its opposite end, said side wall having a pair of opposite cut-out portions formed therein and respectively extending from said open end towards said end wall for accommodating hydraulic hoses for said motor, said cut-out portions forming a pair of upstanding leg portions; a speed-reducing gear box in said housing having an output shaft extending through an opening in one end wall and adapted to have an auger attached thereto; a hydraulic motor in said housing operatively coupled to said gear box; a first pin having opposite ends connected respectively to said leg portions across said housing; a first sleeve rotatably mounted over said first pin between said leg portions; a second sleeve fixedly secured to said first sleeve and extending at right angles thereto; and a second pin rotatably received in said second sleeve and having opposite ends connected respectively to said elements.

2. A hydraulically driven post hole auger apparatus comprising: a front end loading tractor including a power-actuated arm having opposite ends with one of said ends pivotally connected to said tractor; a housing having a pair of upstanding leg portions and an end wall; a speed reducing transmission in said housing having an output shaft extending through an opening in said end wall and having an auger attached thereto; a hydraulic motor in said housing operatively coupled to said transmission; a first pin having opposite ends connected respectively to said leg portions across said housing; a first sleeve rotatably mounted over said first pin between said leg portions; a second sleeve fixedly secured to said first sleeve and extending at right angles thereto; a second pin rotatably received in said second sleeve; a support member including a pair of spaced elements removably connected to one side of said arm and extending laterally therefrom; said second pin extending between and being secured to said spaced elements so that said housing and auger depends therefrom at a position laterally offset from said arm said support member including first and second plates respectively engaging opposite sides of said arm and fastener means for connecting said plates and removably clamping the same on said arm, said support elements being secured to one of said plates.

* * * * *